US008441345B2

(12) United States Patent
Tsubakino et al.

(10) Patent No.: US 8,441,345 B2
(45) Date of Patent: May 14, 2013

(54) HYDRAULIC PRESSURE WARNING SYSTEM FOR INTERNAL COMBUSTION ENGINE

(75) Inventors: Yukihiro Tsubakino, Saitama (JP); Shinji Saito, Saitama (JP); Masahiro Kuroki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 544 days.

(21) Appl. No.: 12/720,260

(22) Filed: Mar. 9, 2010

(65) Prior Publication Data

US 2010/0245070 A1 Sep. 30, 2010

(30) Foreign Application Priority Data

Mar. 31, 2009 (JP) ..... 2009-088354

(51) Int. Cl.
*B60Q 1/00* (2006.01)

(52) U.S. Cl.
USPC ..... 340/451

(58) Field of Classification Search ..... 340/451, 340/450.3, 501; 123/196 R
See application file for complete search history.

(56) References Cited

U.S. PATENT DOCUMENTS

| | | | | |
|---|---|---|---|---|
| 6,111,499 | A * | 8/2000 | Morikami | 340/450.3 |
| 6,481,389 | B2 * | 11/2002 | Suzuki et al. | 123/41.35 |
| 2001/0015189 | A1 * | 8/2001 | Furuya et al. | 123/195 C |
| 2005/0009420 | A1 * | 1/2005 | Yoshida et al. | 440/88 L |
| 2005/0143224 | A1 * | 6/2005 | Aoki et al. | 477/176 |

FOREIGN PATENT DOCUMENTS

| | | |
|---|---|---|
| JP | 08-312507 | 11/1996 |
| JP | 2006-283567 | 10/2006 |

* cited by examiner

*Primary Examiner* — Phung Nguyen
(74) *Attorney, Agent, or Firm* — Birch, Stewart, Kolasch & Birch, LLP

(57) ABSTRACT

A hydraulic pressure warning system for an internal combustion engine including a hydraulic pressure sensor that is prevented from being influenced by the heat of the engine and by the pulsation of an oil pump. A hydraulic pressure sensor detects hydraulic pressure in a lubricating oil passage of the engine and issues a warning based on hydraulic pressure detected by the hydraulic pressure sensor when the hydraulic pressure drops. The hydraulic pressure sensor is provided on a wall surface of a water jacket of a rear cylinder block so as to project therefrom.

18 Claims, 6 Drawing Sheets

HYDRAULIC PRESSURE WARNING SYSTEM FOR INTERNAL COMBUSTION ENGINE

CROSS-REFERENCE TO RELATED APPLICATIONS

The present application claims priority under 35 USC 119 to Japanese Patent Application No. 2009-088354 filed on Mar. 31, 2009 the entire contents of which are hereby incorporated by reference.

BACKGROUND OF THE INVENTION

1. Field of the Invention

The present invention relates to a hydraulic pressure warning system for an internal combustion engine equipped with a hydraulic pressure sensor.

2. Description of Background Art

An internal combustion engine is known wherein a hydraulic pressure sensor for detecting the hydraulic pressure of lubricating oil is installed in an oil passage inside a crankcase sidewall and on the downstream side of and in proximity to an oil pump. See, for example, Japanese Patent Laid-open No. 2006-283567. In addition, a hydraulic pressure warning system is know that is adapted to warn of the lowering of hydraulic pressure of the lubricating oil of the internal combustion engine on the basis of the detection of a hydraulic pressure sensor. See, for example, Japanese Patent Laid-open No. Hei 8-312507.

In addition, the internal combustion engine described in Japanese Patent Laid-open No. 2006-283567 has the hydraulic pressure sensor directly attached thereto. Therefore, the hydraulic pressure sensor may probably be influenced by heat radiated from the internal combustion engine. The hydraulic pressure sensor described in Japanese Patent Laid-open No. 2006-283567 is installed in the oil passage on the downstream side of and in proximity to the oil pump. More specifically, the sensor is located close to the oil pump. Therefore, the hydraulic pressure sensor tends to be influenced by the pulsation of the oil pump. Thus, like the hydraulic pressure warning system described in Japanese Patent Laid-open No. Hei 8-312507, when a warning is about to be given the lowering of the hydraulic pressure based on the detection of the hydraulic pressure sensor, it may probably not be given in an appropriate manner.

SUMMARY AND OBJECTS OF THE INVENTION

According to an embodiment of the present invention, a hydraulic pressure warning system for an internal combustion engine is provided wherein a hydraulic pressure sensor is prevented from being influenced by heat of the engine and by pulsations of an oil pump.

To solve the above-mentioned problem, according to an embodiment of the present invention, a hydraulic pressure warning system for an internal combustion engine is provided including a hydraulic pressure sensor detecting hydraulic pressure in a lubricating oil passage of the engine, issuing a warning based on hydraulic pressure detected by the hydraulic pressure sensor when the hydraulic pressure lowers, and wherein the hydraulic pressure is provided on a wall surface of a water jacket of a cylinder so as to project therefrom.

With this configuration, the hydraulic pressure sensor is provided on the wall surface of the water jacket of the cylinder, that is, it can be provided at a portion, of the cylinder, cooled by cooling water passing through the water jacket.

Therefore, the hydraulic pressure sensor can be prevented from being influenced by heat of the internal combustion engine.

In addition, since the hydraulic pressure sensor is not influenced by the heat of the internal combustion engine, it is not necessary to install a special cooling device used only to cool the hydraulic pressure sensor.

Further, since the hydraulic pressure sensor is disposed on the wall surface of the water jacket at a position remote from an oil pump, the pulsation of the oil pump can be damped in the lubricating oil passage up to the hydraulic pressure sensor. Thus, the hydraulic pressure sensor can be prevented from being influenced by the pulsation of the oil pump.

In the configuration described above, the internal combustion engine may include a main gallery adapted to distribute lubricating oil discharged from an oil pump to journal bearings for a crankshaft, and a sub gallery branched from the main gallery and adapted to distribute lubricating oil to a cylinder head. In addition, the hydraulic pressure sensor may be disposed on an upstream side of an orifice in front of an oil feed portion of the cylinder head downstream of the sub gallery.

With this configuration, since the hydraulic pressure sensor is disposed on the sub gallery further downstream of the main gallery remotely from the oil pump, it is possible to prevent the hydraulic pressure pump from being influenced by the hydraulic pressure variations resulting from the pulsations of the oil pump. The hydraulic pressure sensor is disposed upstream of the orifice. More specifically, the hydraulic pressure sensor is disposed at a position where the oil passage is not yet reduced in diameter by the orifice so that it is difficult for hydraulic pressure to drop. Therefore, the hydraulic pressure can stably be detected by the hydraulic pressure sensor.

The internal combustion engine may be a V-type internal combustion engine having cylinders disposed in a V-shape, and the hydraulic pressure sensor may be disposed in a V-bank.

In this case, since the hydraulic pressure sensor is disposed in the V-bank, it can be protected from disturbance or the like without the provision of a special protecting member or the like.

In the hydraulic pressure warning system of the internal combustion engine according to an embodiment of the present invention, the hydraulic pressure sensor is provided at a portion, of the cylinder, cooled by cooling water passing through the water jacket. Therefore, the hydraulic pressure sensor can be prevented from being influenced by the heat of the internal combustion engine. In addition, since the hydraulic pressure sensor is not influenced by heat of the internal combustion engine, it is not necessary to install a special cooling device used to cool the hydraulic pressure sensor.

Further, the hydraulic pressure sensor is disposed on the wall surface of the water jacket at a position remote from the oil pump. Therefore, the pulsation of the oil pump can be dampened in the lubricating oil passage up to the hydraulic pressure sensor. Thus, it is possible to prevent the hydraulic pressure sensor from being influenced by the pulsation of the oil pump.

The hydraulic pressure sensor is provided further downstream of the main gallery remotely from the oil pump. Therefore, it is possible to prevent the hydraulic pressure sensor from being influenced by the pulsation of the oil pump. Since the hydraulic pressure sensor is disposed at a position where it is difficult for the hydraulic pressure upstream of the orifice to drop, hydraulic pressure can be detected stably.

In addition, since the hydraulic pressure sensor is provided in the V-bank, it can be protected from disturbance or the like without the provision of a special protecting member or the like.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A preferred embodiment of the present invention will hereinafter be described with reference to the drawings.

Figure 1:
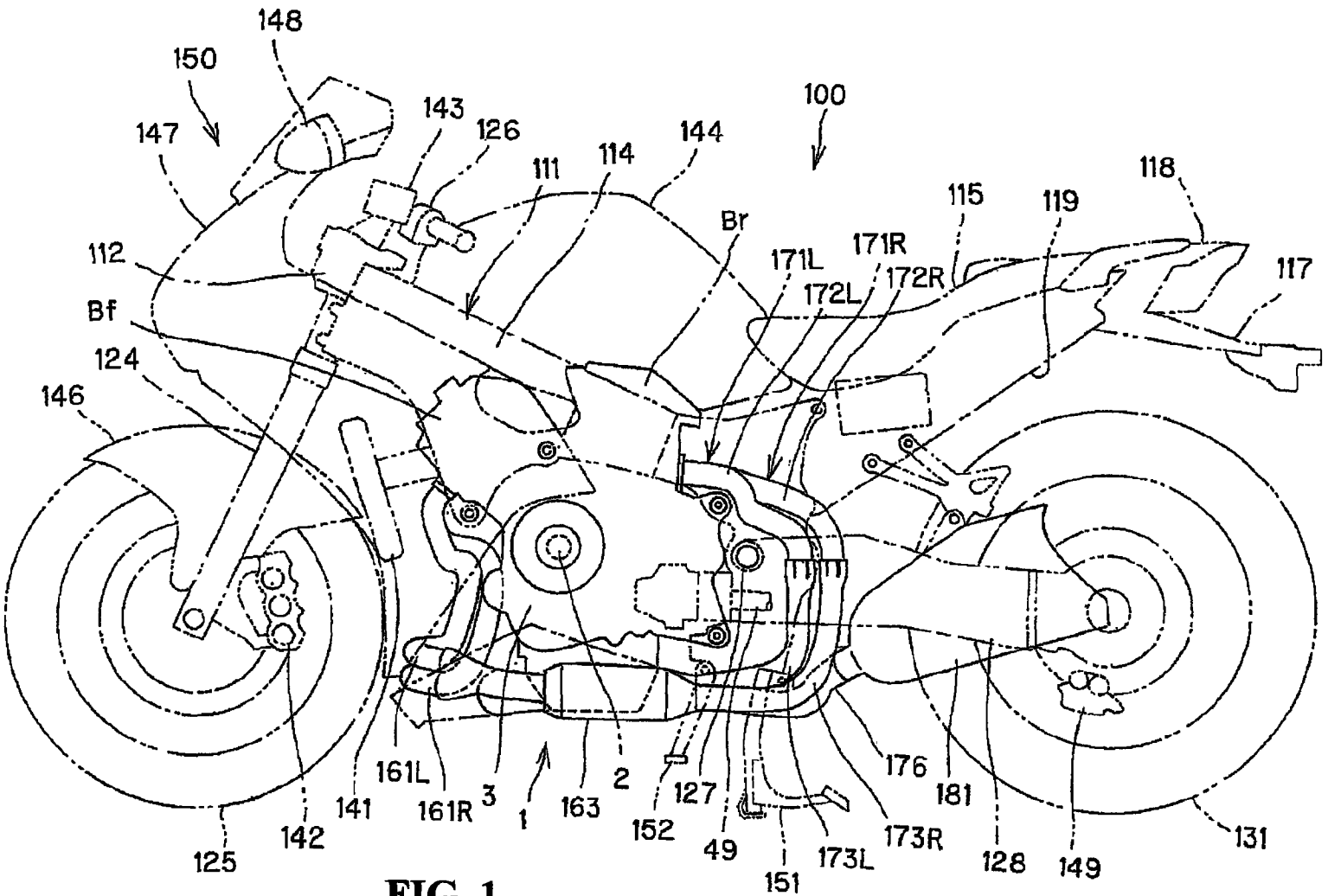
FIG. 1 is a lateral view of a motorcycle on which an internal combustion engine according to an embodiment of the invention is mounted.

FIG. 1 is a lateral view of a motorcycle on which an internal combustion engine according to the embodiment of the present invention is mounted. In the following explanation, the descriptions of directions such as the front, rear, left, right, upside and downside are based on a vehicle body.

A body frame 111 of a motorcycle 100 includes a head pipe 112 located in a front portion of a vehicle body; main frames 114 extending rearward from the head pipe 112 to the center of the vehicle body; and rear frames (not illustrated) extending from rear ends of the main frames 114 to a rear portion of the vehicle.

A front fork 124 is turnably coupled to the head pipe 112. A front wheel 125 is rotatably supported by the lower end of the front fork 124. A steering handlebar 126 is mounted to the upper portion of the head pipe 112. In FIG. 1, a front wheel brake 142 and a front master cylinder 143 are provided.

A front-rear V-type 4-cylinder internal combustion engine 1 is disposed below the main frames 114. This internal combustion engine 1 is transversely installed such that a crankshaft 2 is oriented in a left-right horizontal direction. The engine 1 is of an OHC, water-cooled type and has a crankcase 3. A front bank (cylinder) Bf and a rear bank (cylinder) Br each including two cylinders are formed in a V-shape so as to be tilted forward and rearward, respectively, from the crankcase 3 and to have a bank angle smaller than 90 degrees.

A pair of left and right exhaust pipes 161L, 161R are connected at one end to exhaust ports of the front bank Bf. The exhaust pipes 161L, 161R extend downward from the exhaust ports, then extending toward the rear of the vehicle body, and are connected to a cylindrical catalyst device 163 located below the crankcase 3. A pair of left and right exhaust pipes 171L, 171R are connected at one end to exhaust ports of the rear bank Br. The exhaust pipe 171L is configured to include an upper exhaust pipe 172L extending downward from the exhaust port and a lower exhaust pipe 173L extending downward from the upper exhaust pipe 172L, then further extending toward the front of the vehicle body, and is connected to the catalyst device 163. Similarly, the exhaust pipe 171R is configured to include an upper exhaust pipe 172R extending downward from the exhaust port and a lower exhaust pipe 173R extending downward from the upper exhaust pipe 172R, then further extending toward the front of the vehicle body, and is connected to the catalyst device 163. The catalyst 163 is connected via a single exhaust pipe 176 to a muffler 181 disposed to the rear of the internal combustion engine 1.

A pivot shaft 127 is provided rearward of the internal combustion engine 1. A rear fork 128 is attached to the pivot shaft 127 so as to be vertically swingable around the pivot shaft 127. A rear wheel 131 is rotatably supported by the rear end portion of the rear fork 128. A rear wheel brake 149 is attached to the rear wheel 131. The rear wheel 131 and the internal combustion engine 1 are connected by a drive shaft 49 installed in the rear fork 128. The rotary power from the internal combustion engine 1 is transmitted via the drive shaft 49 to the rear wheel 131. A rear shock absorber (not shown) is spanned between the rear fork 128 and the body frame 111 to absorb impact from the rear fork 128.

A stand 151 for parking the vehicle body is provided at the rear portion of the internal combustion engine 1. A side stand 152 is provided at a lower portion of a left lateral surface of the internal combustion engine 1.

A radiator 141 is disposed in front of the internal combustion engine 1. A fuel tank 144 is mounted on the upper portion of the main frame 114 so as to cover the internal combustion engine 1 from above. A seat 115 is located rearward of the fuel tank 144 and supported by the rear frames. A tail lamp 118 is disposed to the rear of the seat 115. A rear fender 117 is disposed below the tail lamp 118 to cover the rear wheel 131 from above.

The motorcycle 100 has a resin-made body cover 150 covering the vehicle body. The body cover 150 includes a front cover 147 continuously covering from the front of the body frame 111 to the front portion of the internal combustion engine 1. A mirror 148 is attached to the upper portion of the front cover 147. A front fender 146 is attached to the front fork 124 to cover the front wheel 125 from above.

Figure 2:
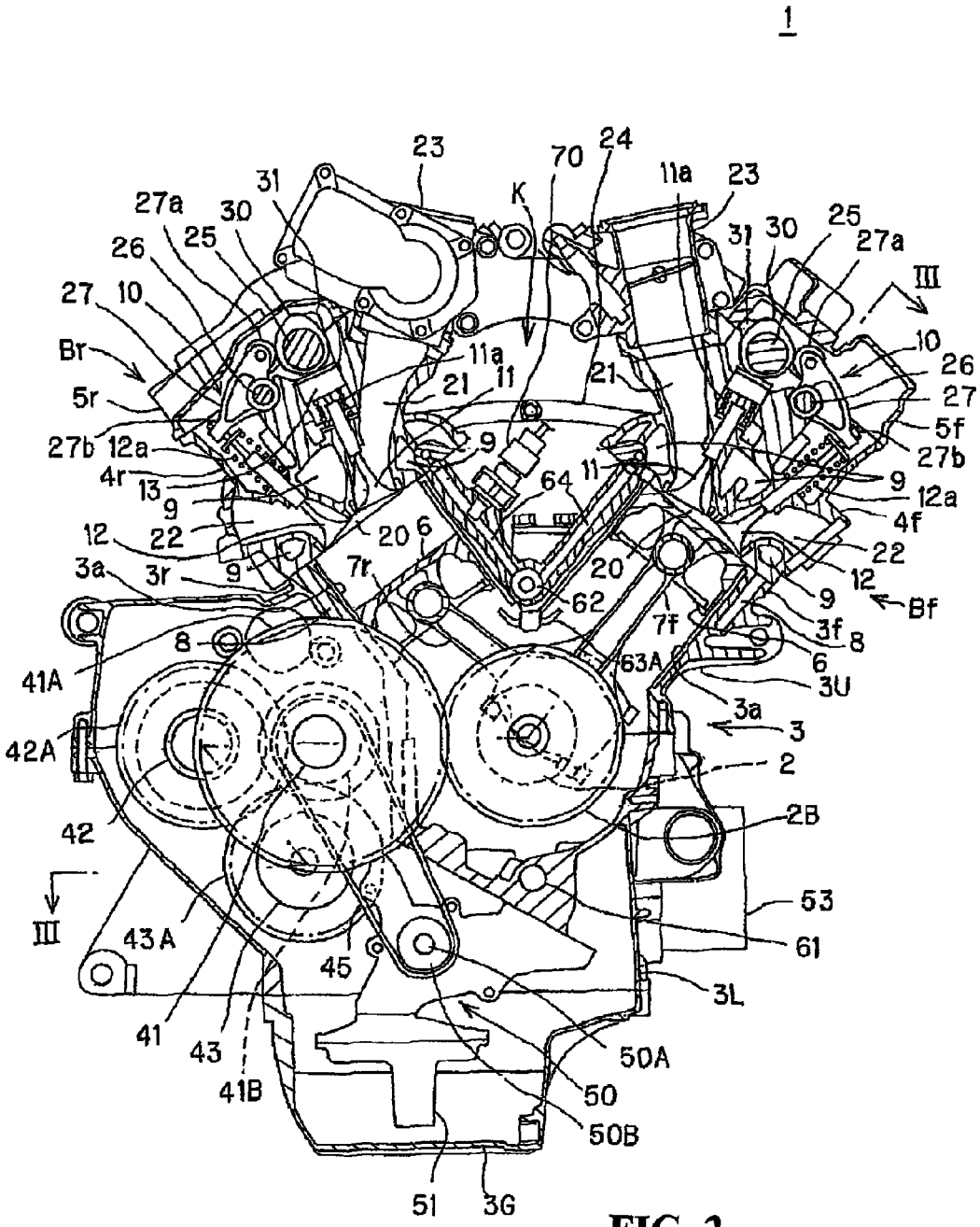
FIG. 2 is a cross-sectional view illustrating an internal combustion engine.

FIG. 2 is a cross-sectional view of the internal combustion engine 1. In addition, the following description is provided with the upside and downside of FIG. 2 taken as the upside and downside, respectively, of the internal combustion engine 1 and with the right side and left side of FIG. 2 taken as the front side and rear side, respectively, of the engine 1.

A V-bank space K which is a space formed in a V-shape as viewed from the side is formed between the front bank Bf and the rear bank Br.

The crankcase 3 is configured to be vertically split into an upper crankcase 3U and a lower crankcase 3L. A crankshaft 2 is rotatably supported so as to be put between the crankcases 3U, 3L. The upper crankcase 3U is formed integrally with a front cylinder block 3*f* and a rear cylinder block 3*r* each of which has two cylinders arranged right and left and which extend obliquely upward to form a V-shape as viewed from the side.

An oil pan 3G for storing oil (lubricating oil) of the internal combustion engine 1 therein is provided at a lower portion of the lower crankcase 3L so as to protrude downward. An oil pump 50 for circulating oil in the internal combustion engine 1 is located below the crankshaft 2 in the lower crankcase 3L. The oil pump 50 is a trochoid pump.

A front cylinder head 4*f* is placed from the oblique front on the front cylinder block 3*f* and fastened thereto by means of fastening bolts (not shown). In addition, a front cylinder head cover 5*f* covers the front cylinder head 4*f* from above. Similarly, a rear cylinder head 4*r* is placed from the oblique rear on the rear cylinder block 3*r* and fastened thereto by means of fastening bolts (not shown). In addition, a rear cylinder head cover 5*r* covers the rear cylinder head 4*r* from above.

The front cylinder block 3*f* and the rear cylinder block 3*r* are each formed with a cylinder bore 3*a*. A piston 6 is disposed so as to reciprocate in the cylinder bore 3*a*. The pistons 6 are connected via corresponding connecting rods 7*f*, 7*r* to the single common crankshaft 2.

The cylinder blocks 3*f*, 3*r* are provided with respective water jackets 8 which surround the corresponding cylinder bores 3*a* and in which cooling water flows to cool the corresponding cylinder blocks 3*f*, 3*r*.

The front cylinder head 4*f* and the rear cylinder head 4*r* are provided with combustion chambers 20, intake ports 21 and exhaust ports 22 which are located above the corresponding cylinder bores 3*a*. A throttle body 23 is connected to each of the intake ports 21 to adjust the amount of mixture flowing to the intake port 21.

The cylinder heads 4*f*, 4*r* are provided with respective water jackets 9 which surround the intake ports 21 and the exhaust ports 22 and in which cooling water flows to cool the cylinder heads 4*f*, 4*r*. The water jackets 9 of the cylinder heads 4*f*, 4*r* is connected by a cooling water tube 24 provided in the V-bank space K. In addition, the water jackets 9 are connected to the water jackets 8.

A pair of intake valves 11 are arranged on each of the cylinder heads 4*f*, 4*r* in an openable and closable manner so as to be biased by corresponding valve springs 11*a* in a direction of closing the intake ports 21. A pair of exhaust valves 12 are arranged on each of the cylinder heads 4*f*, 4*r* in an openable and closable manner so as to be biased by corresponding valve springs 12*a* in a direction of closing the exhaust ports 22.

The intake valves 11 and the exhaust valves 12 are drivingly opened and closed by a uni-cam type valve train 10 in which the intake valves 11 and the exhaust valves 12 are driven by a camshaft 25 disposed for each of the cylinder heads 4*f*, 4*r*.

The valve train 10 includes a camshaft 25 located above the intake valves 11 and rotatably supported by each of the cylinder heads 4*f*, 4*r*; a rocker shaft 26 having an axis parallel to the camshaft 25 and secured to each of the cylinder heads 4*f*, 4*r*; and a rocker arm 27 swingably supported by the rocker shaft 26.

The camshaft 25 has intake cams 30 and exhaust cams 31 which project toward the outer circumferential side of the camshaft 25 and is rotated in synchronization with the rotation of the crankshaft 2. The intake cam 30 and the exhaust cam 31 each have a cam profile with an irregular distance (radius) from the center to the outer circumference. The variations of the radius encountered when the intake cam 30 and the exhaust cam 31 are rotated move the intake valves 11 and the exhaust valves 12 upward and downward.

A valve lifter 13 is disposed between the camshaft 25 and the intake valve 11 so as to be slidably fitted to each of the cylinder heads 4*f*, 4*r* at a position below the camshaft 25.

A roller 27*a* is provided at one end of the rocker arm 27 pivotally supported by the rocker shaft 26 so as to rolling-contact the exhaust cam 31. In addition, a tappet screw 27*b* is screwed to the other end of the rocker arm 27 so as to be abutted against the upper end of the exhaust valve 12 and to be able to adjust its advancing and retreating position.

If the intake cams 30 and the exhaust cams 31 are rotated along with the camshaft 25, the intake cams 30 depress the intake valves 11 via the valve lifters 13 and the exhaust cams 31 depress the exhaust valves 12 via the rocker arms 27. Thus, the intake ports 21 and the exhaust ports 22 are opened and closed at predetermined timings determined depending on the rotational phase of the intake cam 30 and of the exhaust cam 31.

Figure 3:
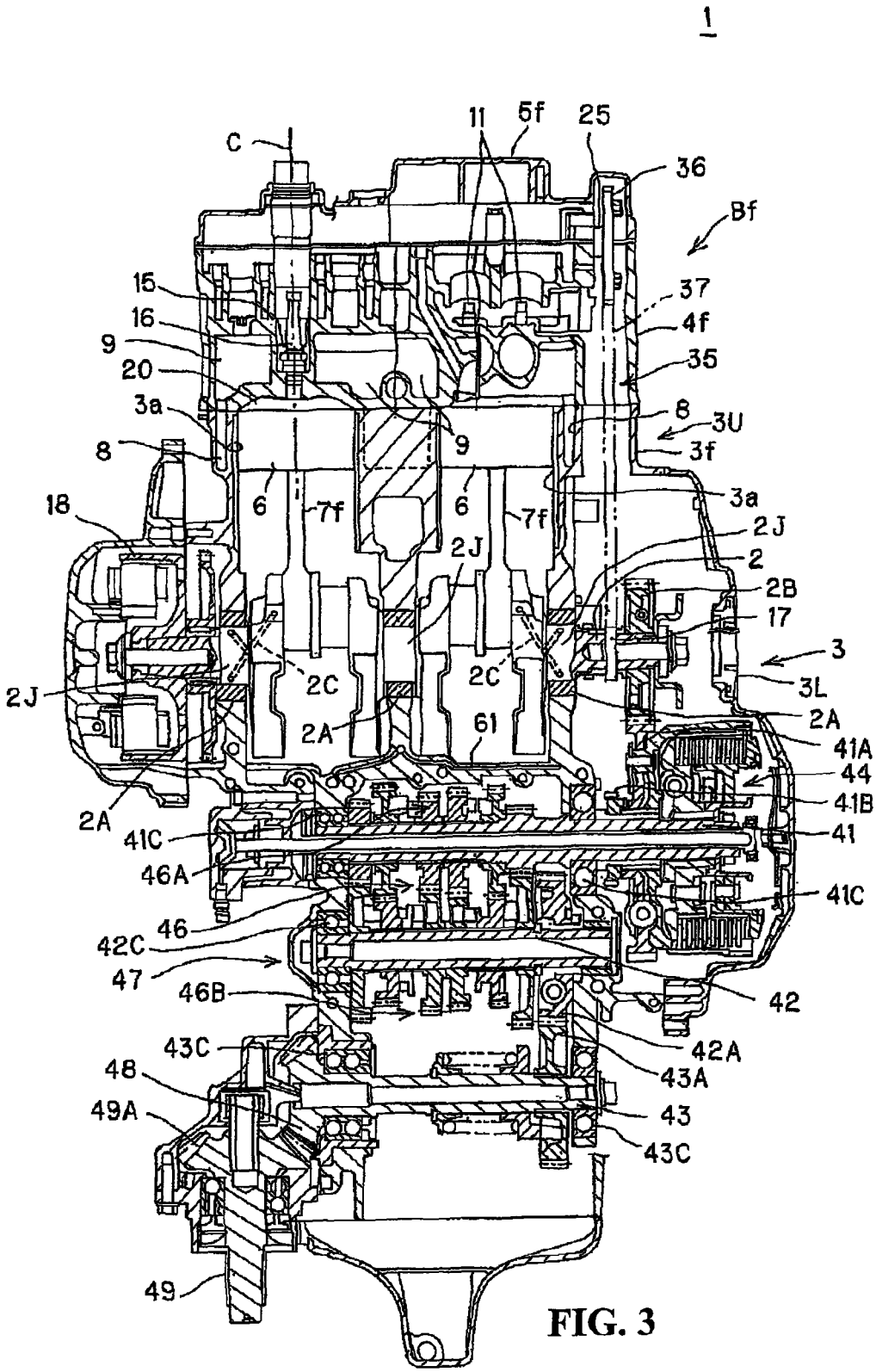
FIG. 3 is a cross-sectional view taken along line III to III of FIG. 2.

FIG. 3 is a cross-sectional view taken along line III to III of FIG. 2. FIG. 3 illustrates the cross-section of the front bank Bf. However, the inside of the rear bank Br is configured similarly to that of the front bank Bf; therefore, the explanation of the rear bank Br is omitted.

Each cylinder of the cylinder head 4*f* is formed with a plug insertion hole 15 on a cylinder axis C which is a central axis of the cylinder bore 3*a*. An ignition plug 16 (the ignition plug of the right cylinder is not illustrated in the figure) is disposed in the plug insertion hole 15 so as to have a leading end facing the inside of the combustion chamber 20.

The crankshaft 2 is supported in the crankcase 3 via a plurality of journal bearings 2A disposed at respective positions corresponding to crank journals 2J located at both ends and an intermediate portion in the axial direction thereof.

A camshaft drive sprocket 17, adapted to output the rotation of the crankshaft 2, is provided at one end side of the crankshaft 2. A cam chain chamber 35 vertically extending in each of the banks Bf, Br is provided on the side of the camshaft drive sprocket 17 of the internal combustion engine 1. A driven sprocket 36 is secured by one end of the camshaft 25 and located in the cam chain chamber 35 so as to be rotated integrally with the camshaft 25. A cam chain 37 is wound around the driven sprocket 36 and the camshaft drive sprocket 17. The camshaft 25 is rotated at a rotary speed half that of the crankshaft 2 via the cam chain 37 and the driven sprocket 36.

A generator 18 as an electric dynamo is mounted to the other end side of the crankshaft 2.

The main shaft 41, the counter shaft 42 and the output shaft 43 are installed in the crankcase 3 in parallel to the crankshaft 2. These shafts including the crankshaft 2 constitute a gear transmission mechanism adapted to transmit the rotation of the crankshaft 2 in the order of the main shaft 41, the counter shaft 42 and the output shaft 43. FIG. 3 is a cross-sectional view taken along a cross-section connecting together the front bank Bf, the crankshaft 2, the main shaft 41, the counter shaft 42 and the output shaft 43 with straight lines.

A crank-side drive gear 2B, adapted to rotate the main shaft 41, is secured to an end of the crankshaft 2 close to the cam chain chamber 35. The crank-side drive gear 2B meshes with a main shaft-side driven gear 41A of the main shaft 41. The main shaft 41 is supported by bearings 41C provided on both sides thereof.

The main shaft-side driven gear 41A is provided on the main shaft 41 so as to be rotatable relatively thereto and is connected to a clutch mechanism 44. The operation of the clutch mechanism 44 can connect and disconnect the transmission of the power between the crankshaft 2 and the main shaft 41.

The main shaft-side driven gear 41A is provided with an oil pump drive gear 41B adapted to drive an oil pump 50. The oil pump drive gear 41B is rotated integrally with the main shaft-side driven gear 41A regardless of the engagement or disengagement of the clutch mechanism 44. Thus, as illustrated in FIG. 2, the rotation of the crankshaft 2 is transmitted via the drive chain 45 to the driven gear 50B secured to the drive shaft 50A of the oil pump 50 for driving the oil pump 50.

The counter shaft 42 is supported by bearings 42C. Speed-change gear groups 46 are arranged to straddle between the countershaft 42 and the main shaft 41, which constitutes a transmission 47. More specifically, a drive gear 46A for 6 speeds is provided on the main shaft 41. A driven gear 46B for 6 speeds is provided on the counter shaft 42. The drive gear 46A is engaged with the driven gear 46B for each speed-change stage to constitute a speed-change gear pair. In addition, the speed-change gear pairs are reduced in reduction ratio in the order from first-speed to sixth-speed (to become higher-speed gears). The counter shaft 42 has a counter-side drive gear 42A adapted to transmit the rotation of the counter shaft 42 to the output shaft 43.

The output shaft 43 is supported by bearings 43C attached to both ends of the output shaft 43 and has a driven gear 43A meshing with the counter-side drive gear 42A. A drive bevel gear 48 is provided integrally with the left end portion of the output shaft 43. The drive bevel gear 48 meshes with a driven bevel gear 49A provided integrally with the front end of the drive shaft 49 extending in the back and forth direction of the vehicle body. In this way, the rotation of the output shaft 43 is transmitted to the drive shaft 49.

A description is next given about lubrication of the inside of the internal combustion engine 1 with oil.

As illustrated in FIG. 2, oil used to lubricate sliding portions inside the internal combustion engine 1 is stored in the oil pan 3G. The sliding portions include portions of the internal combustion engine 1 that perform rotation, sliding or other movements, such as the pistons 6, the crankshaft 2, the journal bearings 2A, the camshaft 25, the shafts 41, 42, 43 and the like. The oil performs the functions of anticorrosion, cooling, clarification and the like as well as lubrication.

An oil strainer 51 is disposed below the oil pump 50 so as to dip into the oil in the oil pan 3G. The oil sucked into the oil pump 50 is filtered while passing through the oil strainer 51. The oil in the oil pan 3G is discharged from the oil pump 50, passing through oil passages formed in the internal combustion engine 1, and is supplied to various portions of the engine 1.

An oil filter portion 53 is provided below the front cylinder block 3*f* so as to protrude from the lower crankcase 3L.

As illustrated in FIGS. 2 and 3, a main gallery 61 is formed in the lower crankcase 3L and below the crankshaft 2. The main gallery 61 is a lubricating oil passage adapted to distribute oil into the journal bearings 2A of the crankshaft 2 and the like. In addition, the main gallery 61 is an oil passage formed circular in cross-section and in the wall of the lower crankcase 3L.

As illustrated in FIG. 2, in the wall portion of the crankcase 3, a sub gallery 62 is formed at a portion where the front cylinder block 3*f* and the rear cylinder block 3*r* forms a V-shape, i.e., at a portion below the V-bank space K. The sub gallery 62 is a lubricating oil passage branched from the main gallery 61 for distributing oil into the cylinder heads 4*f*, 4*r* and the like.

The sub gallery 62 is formed at the portion where the front cylinder block 3*f* and the rear cylinder block 3*r* intersect with each other in a V-shape. The sub gallery 62 is an oil passage formed circular in cross-section in the wall of the upper crankcase 3U and extends generally parallel to the crankshaft 2. A plurality of branch oil passages 64 branch from the sub gallery 62 and extend upward in the wall portions of the cylinder blocks 3*f*, 3*r*.

Piston jets 63A are provided in the crankcase 3 and above the crankshaft 2 to spray oil fed from the sub gallery 62 toward the corresponding pistons 6.

A hydraulic pressure sensor 70 is attached to the rear cylinder block 3*r* to detect the hydraulic pressure of oil flowing in the branch oil passages 64. The branch oil passage 64 is an oil passage circular in cross-section and has a diameter smaller than that of the sub gallery 62. In other words, the branch oil passage 64 is reduced in diameter compared with the sub gallery 62.

Figure 4:
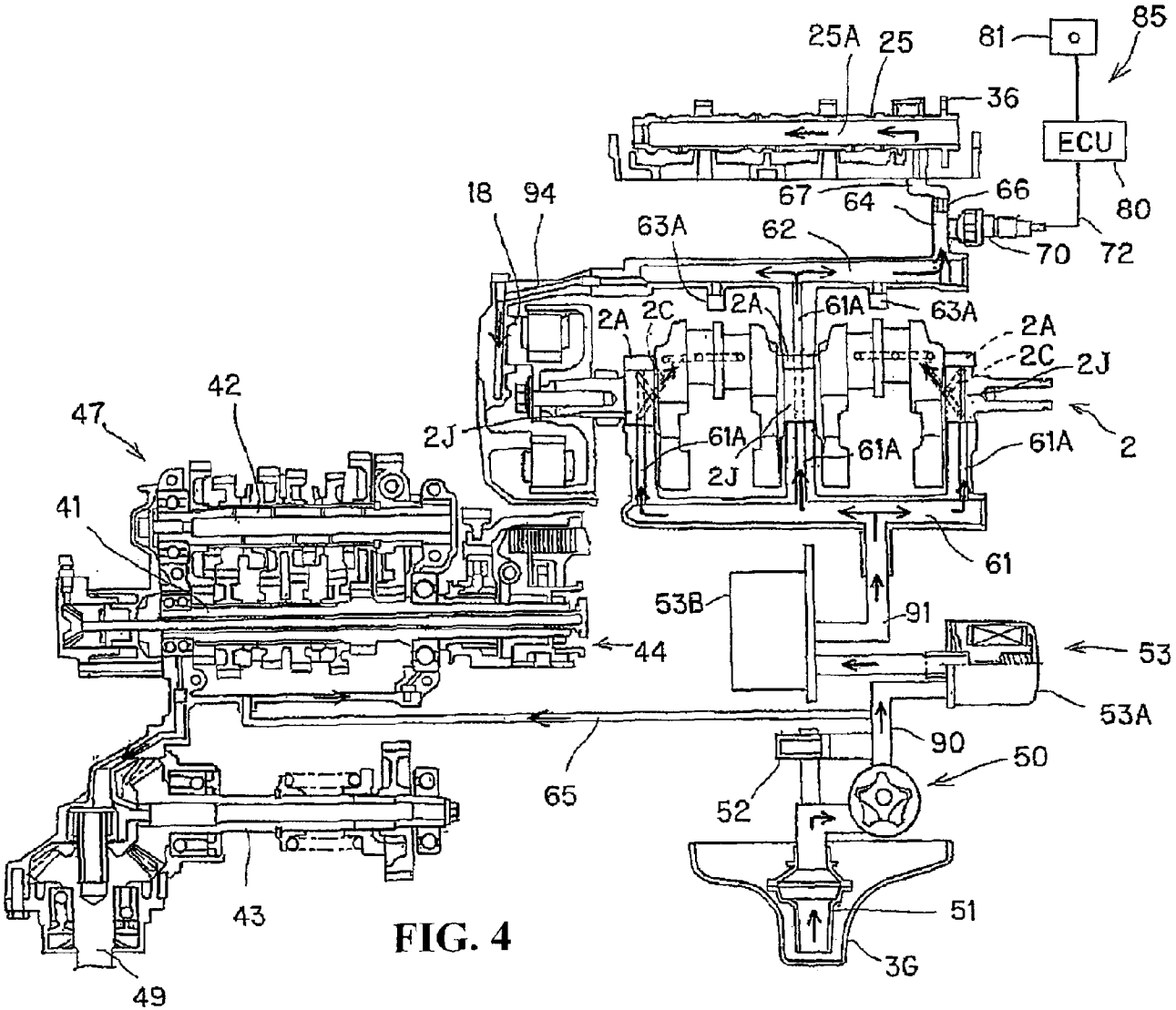
FIG. 4 is a schematic view illustrating a lubricating system of the internal combustion engine.

FIG. 4 is a schematic diagram of a lubricating system of the internal combustion engine 1. A plurality of arrows shown in FIG. 4 denote flowing directions of oil.

FIG. 4 illustrates the oil pump 50, the transmission 47, the crankshaft 2 and the camshaft 25 from the downside of FIG. 4.

The oil pump 50 has a relief valve 52 adapted to prevent oil from being excessively pressurized. Oil discharged from the oil pump 50 enters, via an oil passage 90, the oil filter portion 53 in which the oil is filtered by the oil filter 53A, and then enters an oil cooler 53B in which the oil releases heat to cool. The oil passage 90 is diverged to a shaft-side oil passage 65. Oil passing through the oil passage 90 is partially supplied via the shaft-side oil passage 65 to the shafts 41, 42, 43 in proximity to the transmission 47.

The oil cooled by the oil cooler 53B passes through an oil passage 91 connecting the oil cooler 53B with the main gallery 61 and flows into the main gallery 61.

The main gallery 61 has a plurality of supply oil passages 61A communicating with the corresponding crank journals 2J located at both the ends and center of the crankshaft 2. The supply oil passages 61A are each connected to a corresponding one of a plurality of in-shaft oil passages 2C formed inside the crankshaft 2. Oil is supplied through the oil passages 2C to the crank journals 2J and the journal bearings 2A of the crankshaft 2, and the connecting rods 7*f*, 7*r* (FIG. 2).

The supply oil passage 61A communicating with the central crank journal 2J is connected to the sub gallery 62 and is formed as a flow passage with a diameter smaller than that of the main gallery 61.

Oil divided to the sub gallery 62 is sprayed from the piston jets 63A to the corresponding pistons 6 for lubrication and cooling. The sub gallery 62 is diverged to a branch oil passage 64 and also communicates with a generator-side oil passage 94 adapted to supply oil to the generator 18.

The oil divided to the branch passage 64 flows toward the respective camshafts 25 of the cylinder heads 4*f*, 4*r*. Then, the oil passes through an in-camshaft oil passage 25A formed in the camshaft 25 and is supplied to oil-fed portions in the cylinder heads 4*f*, 4*r*, such as the intake cams 30, the exhaust cams 31 and the rocker arms 27. The oil fed to the oil-fed portions in the cylinder heads 4*f*, 4*r* drops in the cam chain chamber 35, returning to the oil pan 3G.

An orifice 66 is disposed in the branch passage 64 on the upstream side of the oil-fed portions in each of the cylinder heads 4*f*, 4*r* to reduce the flow of oil passing through the branch passage 64.

The internal combustion engine 1 has a hydraulic pressure warning system 85 which issues a warning when the hydraulic pressure of oil flowing in the lubricating oil passages of the engine 1 drops below a predetermined level. The hydraulic pressure warning system 85 includes the hydraulic pressure sensor 70, an ECU 80 for controlling various portions of the motorcycle including the internal combustion engine 1, and a hydraulic pressure warning lamp 81 lit by the ECU 80.

The hydraulic pressure sensor 70 is installed in the branch oil passage 64 on the upstream side of the orifice 66 and connected to the ECU 80 via a cable 72. The ECU 80 is connected to the hydraulic pressure warning lamp 81. When the hydraulic pressure detected by the hydraulic pressure sensor 70 drops below a predetermined hydraulic pressure lower limit, the ECU 80 illuminates the hydraulic pressure warning lamp 81 to notify a user or the like of the abnormality of hydraulic pressure of oil flowing in the branch passage 64.

The hydraulic pressure sensor 70 is an electric hydraulic pressure sensor which outputs hydraulic pressure as an electric voltage in a linear relationship relative to various hydraulic pressures detected by the hydraulic pressure sensor 70. The hydraulic pressure sensor 70 can continuously detect the hydraulic pressure of oil flowing in the branch oil passage 64 in a wide hydraulic pressure range from low hydraulic pressure to high hydraulic pressure. In general, hydraulic pressure required by the oil lubricating the internal combustion engine increases with an increase in the rotating speed of the engine. Therefore, it is desirable that the predetermined hydraulic pressure lower limit determined as a hydraulic pressure lower limit by the ECU 80 be varied in accordance with the rotating speed of the engine 1. To that end, it is necessary for the hydraulic pressure sensor 70 to continuously detect the hydraulic pressure of oil in a wide range of hydraulic pressure. For example, a hydraulic pressure switch which detects whether or not hydraulic pressure is lower than a predetermined value on the basis of an on-off of a contact according to the hydraulic pressure may be used as a hydraulic pressure sensor. In such a case, since hydraulic pressure cannot be detected in a wide pressure range, it is impossible to vary the predetermined hydraulic pressure lower limit at which the ECU 80 determines to be a lower limit. In particular, in the state where the internal combustion engine is rotated at high speeds, a large difference occurs between the predetermined appropriate hydraulic pressure lower limit and the above-mentioned predetermined value set in the hydraulic pressure switch.

However, in the present embodiment, the hydraulic pressure sensor 70 uses an electric hydraulic pressure sensor; therefore, the ECU 80 can continuously obtain the hydraulic pressure of oil flowing in the branch oil passage 64 in the wide range of hydraulic pressure from a low hydraulic pressure state to a high hydraulic pressure state. Thus, the ECU 80 can vary the predetermined hydraulic pressure lower limit in accordance with the rotating speed of the internal combustion engine 1 and issue a warning of the lowering of hydraulic pressure on the basis of the variable hydraulic pressure lower limit.

Figure 5:
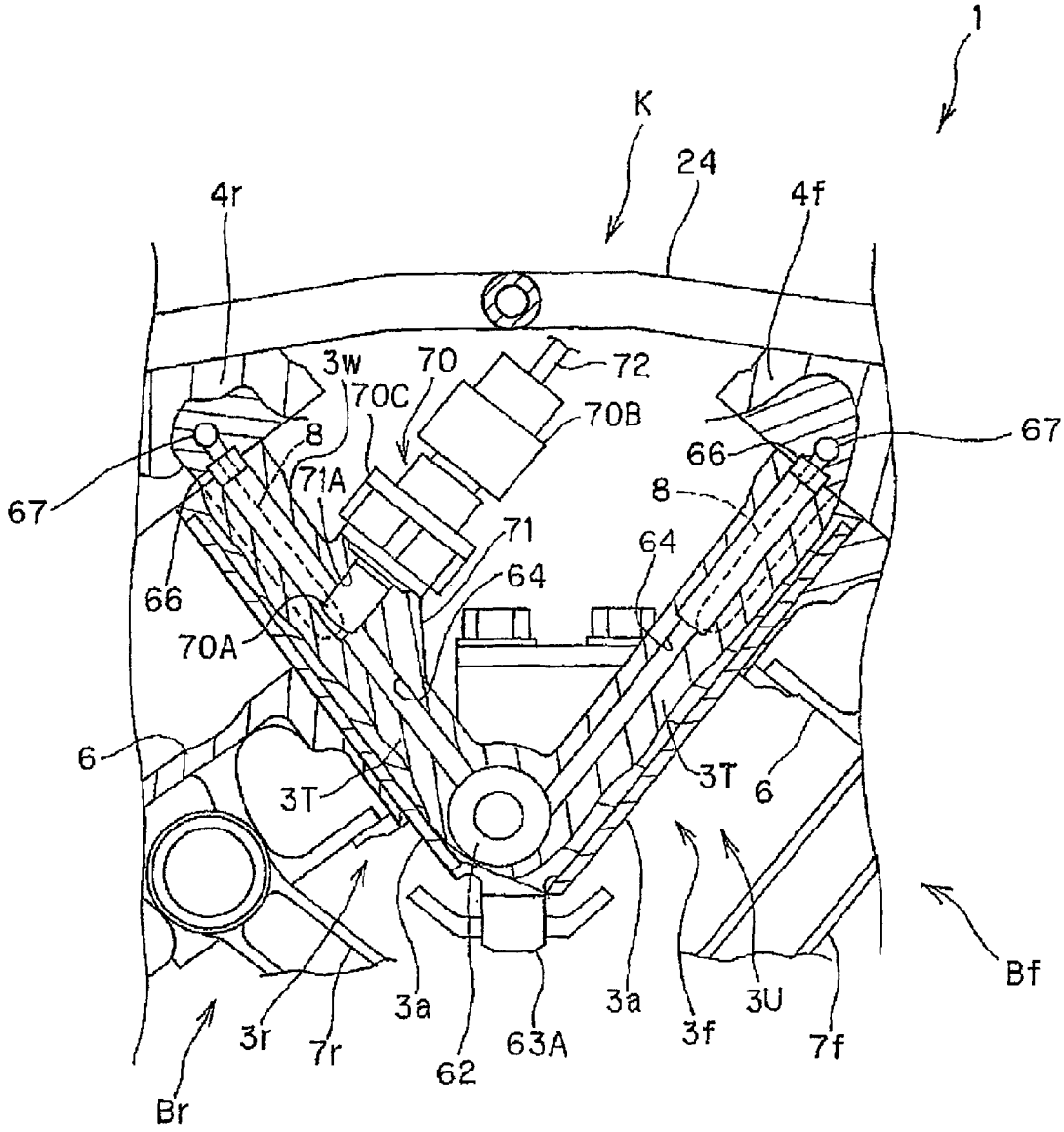
FIG. 5 is an enlarged cross-sectional view illustrating the vicinity of the sub gallery of FIG. 2.
Figure 6:
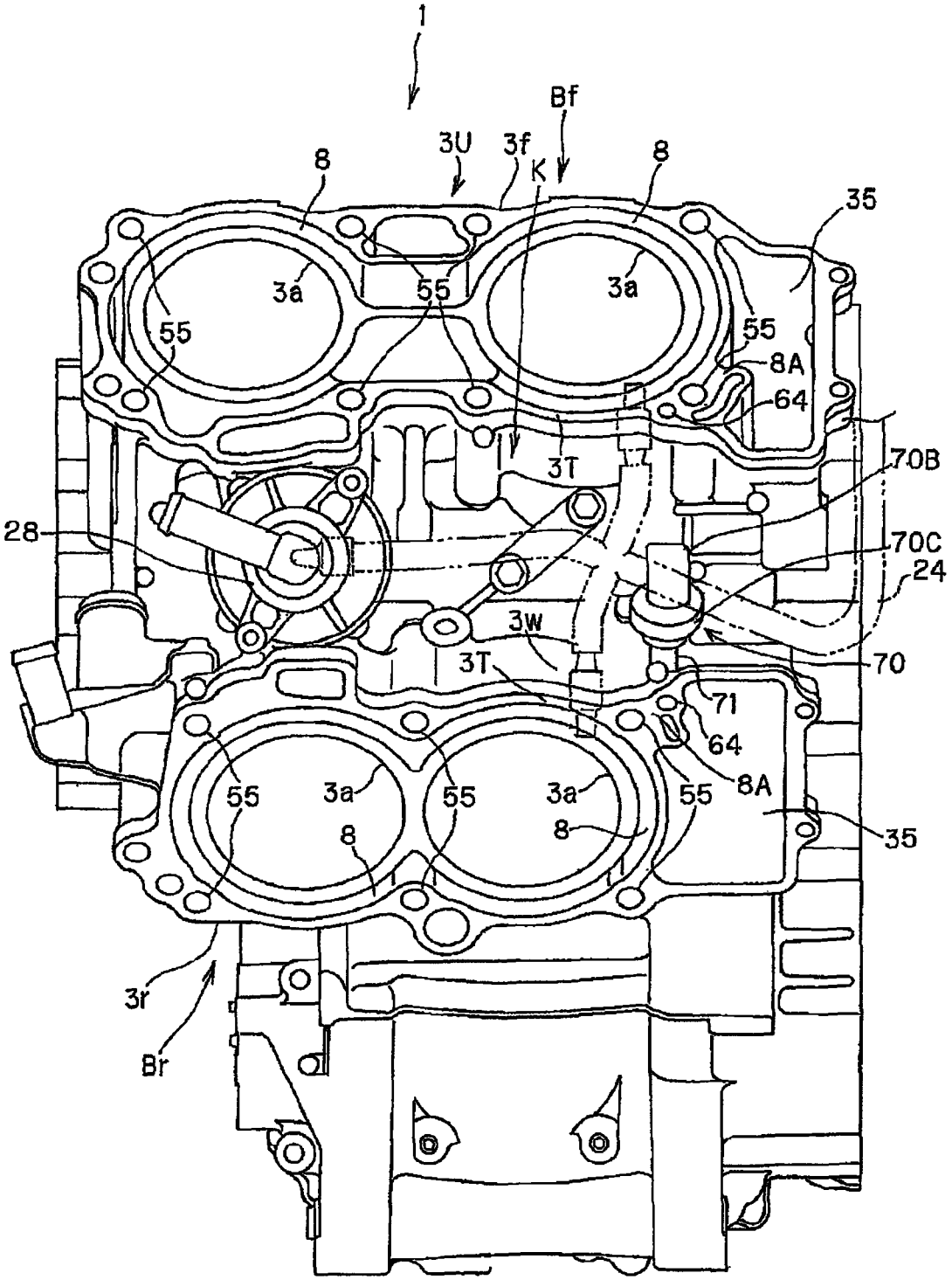
FIG. 6 is a plan view illustrating the vicinity of the hydraulic pressure sensor.

FIG. 5 is an enlarged cross-sectional view illustrating the vicinity of the sub gallery of FIG. 2. FIG. 6 is a plan view illustrating the vicinity of the hydraulic pressure sensor 70, with the cylinder heads 4*f*, 4*r* removed.

As illustrated in FIG. 5, the cylinder heads 4*f*, 4*r* are formed with respective head-side oil passages 67 which communicate with the respective in-camshaft oil passages 25A (see FIG. 4) and are adapted to feed oil to the inside of each of the cylinder heads 4*f*, 4*r*. The head-side oil passages 67 are provided to communicate with the respective branch oil passages 64. The orifices 66 are each interposed between the head-side oil passage 67 and the branch oil passage 64.

The hydraulic pressure in the branch oil passage 64 is stably kept at high levels since the oil passage is restricted on the downstream side by the orifice 66. Accordingly, an accurate and stable detection of hydraulic pressure of oil is promised by providing the hydraulic pressure sensor 70 in the branch oil passage 64.

The hydraulic pressure sensor 70 is provided in the branch oil passage 64 diverging from the sub gallery 62 remotely from the oil pump 50 in the flow passage of oil. Therefore, the variations of pressure due to the pulsation of the oil pump 50 are damped in the flow passage on the upstream side of the hydraulic pressure sensor 70. Thus, the hydraulic pressure sensor 70 can be prevented from being influenced by the pulsation of the oil pump 50 to detect the hydraulic pressure of oil high-accurately and stably.

A hydraulic pressure sensor attachment portion 71 is formed on a wall surface 3W in the V-bank space K so as to be thick and project therefrom. The wall surface 3W forms an external wall surface of the water jacket 8 of the rear cylinder block 3*r*. The hydraulic pressure sensor attachment portion 71 is located at a position corresponding to an intermediate portion of the branch oil passage 64 vertically extending in the rear cylinder block 3*r*. In addition, the hydraulic pressure sensor attachment portion 71 is formed with an attachment hole 71A communicating with the branch oil passage 64. The attachment hole 71A is formed with an internal thread.

The hydraulic pressure sensor 70 is formed like a rod and has at one end a sensor portion 70A for detecting hydraulic pressure, at the other end a connecting portion 70B to which the cable 72 connected to the ECU 80 is connected, and at an intermediate portion a large-diameter portion 70C with a diameter larger than that of the sensor portion 70A. The sensor portion 70A is formed at a proximal end portion with an external thread engaged with the attachment hole 71A. The hydraulic pressure sensor 70 is fixedly fastened to the hydraulic pressure sensor attachment portion 71 by inserting the sensor portion 70A into the attachment hole 71A and fastening it via the large-diameter portion 70C. Entering the inside of the branch oil passage 64, the sensor portion 70A is attached. The hydraulic pressure sensor 70 is projectingly installed below the cooling water tube 24 and on the wall surface 3W so as to be tilted at almost the same angle as the front cylinder block 3*f*. In addition, the upper end or the connecting portion 70B is located at the center of the V-bank space K.

The hydraulic pressure sensor 70 is disposed in proximity to the water jacket 8 of the rear cylinder block 3*r* so that the sensor portion 70A may overlap the water jacket 8 as viewed from the side in FIG. 5.

Referring to FIG. 6, the respective water jackets 8 of the cylinder blocks 3*f*, 3*r* are circularly formed in such a manner that cylinder walls 3T surrounding the respective cylinder bores 3*a* are bored in the axial direction of each cylinder bore 3*a*. A plurality of bolt holes 55, adapted to receive fastening bolts (not shown) inserted therethrough to fasten the cylinder heads 4*f*, 4*r* to the cylinder blocks 3*f*, 3*r*, are formed on the circumference of the water jackets 8.

Cooling water for cooling the internal combustion engine 1 is allowed by the radiator 141 (FIG. 1) to release heat and is circulated in the cooling water passage by a water pump (not shown) installed in the internal combustion engine 1 to cool the cylinder blocks 3*f*, 3*r* and the cylinder heads 4*f*, 4*r* when flowing through the water jackets 8, 9.

The cooling water tube 24 is branched in the V-bank space K to connect together the cylinder heads 4*f*, 4*r* from the front to the rear and has a portion extending toward the side opposite the cam chain chamber 35 and connecting with a thermostat 28 adapted to control the flow of cooling water.

The branch oil passage 64 is formed in a water jacket thick-walled portion 8A of the cylinder wall 3T, close to the V-bank space k, in each of the cylinder blocks 3*r*, 3*r*. In addition, the water jacket thick-walled portion 8A is located between the cam chain chamber 35 and the water jacket 8 adjacent thereto. Further, the water jacket thick-walled portion 8A is formed to allow the cylinder wall 3T to protrude into the cam chain chamber 35. In this way, since the water jacket thick-walled portion 8A is located close to the water jacket 8 through which cooling water flows, it is a portion where temperature is kept low in the rear cylinder block 3*r*.

The hydraulic pressure sensor 70 is disposed at almost the same position as the branch oil passage 64 in the width direction of the internal combustion engine 1. In addition, the hydraulic pressure sensor 70 is attached to the hydraulic pressure sensor attachment portion 71 formed on the wall surface 3W on the side of the water jacket thick-walled portion 8A. As described above, the hydraulic pressure sensor 70 is disposed at the water jacket thick-wall portion 8A where temperature is kept low in the rear cylinder block 3*r* of the internal combustion engine 1. Therefore, it is possible to reduce the heat of the internal combustion engine 1 transmitted to the hydraulic pressure sensor 70. Thus, the hydraulic pressure sensor 70 can be prevented from being influenced by the heat of the internal combustion engine 1.

The oil that flows in the branch oil passage 64 flows from the oil cooler 53B and goes through the main gallery 61 but is not yet be supplied to the rear cylinder head 4*r*. In addition, such oil passes by the water jacket 8. Thus, the temperature of the oil is stable. In this way, the hydraulic pressure sensor 7G can detect the hydraulic pressure of oil stable in temperature for appropriate detection of the hydraulic pressure. Further, the hydraulic pressure sensor 70 is installed by use of the branch oil passage 64 adapted to supply oil to the rear cylinder head 4*r*. Therefore, it is not necessary to install a special oil passage used for the provision of the hydraulic pressure sensor 70. Thus, the lubricating oil passages of the internal combustion engine 1 can be made to have a simple configuration.

The hydraulic pressure sensor 70 is installed to be tilted toward the front cylinder block 3*f* and is located at a position where the hydraulic pressure sensor 70 will not overlap the cooling water tube 24 located thereabove when it is attached or detached. In this way, the cooling water tube 24 will not disturb the attachment and detachment of the hydraulic pressure sensor 70 to and from the hydraulic pressure sensor attachment portion 71. Thus, the hydraulic pressure sensor 70 can be attached and detached with ease without removal of the cooling water tube 24. The branch oil passage 64 is installed in the cylinder wall 3T of the rear cylinder block 3*r* at a position close to the outside of the rear cylinder block 3*r*. Therefore, the hydraulic pressure sensor 70 can be installed only by forming the attachment hole 71A in the cylinder wall 3T and by being inserted thereinto and fastened thereto. Thus, the hydraulic pressure sensor 70 can be installed with a simple configuration.

Further, since the hydraulic pressure sensor 70 is installed close to the cam chain chamber 35 on the lateral surface side of the internal combustion engine 1, it can easily be accessed from the lateral surface, providing satisfactory maintenance performance.

As described above, according to the embodiment of the present invention, the hydraulic pressure sensor 70 is attached to the water jacket thick-walled portion 8A of the rear cylinder block 3*r* and disposed at a portion cooled by the cooling water passing through the water jacket 8. Therefore, it is possible to reduce the heat of the internal combustion engine 1 transmitted to the hydraulic pressure sensor 70, whereby the hydraulic pressure sensor 70 can be prevented from being influenced by the heat of the internal combustion engine 1. Consequently, the hydraulic pressure sensor 70 can use an electric type hydraulic pressure sensor, so that the ECU 80 can continuously obtain the hydraulic pressure of oil flowing in the branch oil passage 64 in a wide range from low hydraulic pressure to high hydraulic pressure. Thus, the predetermined hydraulic pressure lower limit of the ECU 80 can be varied according to the rotating speed of the internal combustion engine 1, so that a warning about the lowering of hydraulic pressure can be issued based on the variable hydraulic pressure lower limit.

Since the hydraulic pressure sensor 70 is not influenced by the heat of the internal combustion engine 1, it is not necessary to install a special cooling device adapted only to cool the hydraulic pressure sensor 70.

Further, since the hydraulic pressure sensor 70 is installed on the wall surface 3W on the outside of the water jacket 8 at a position remote from the oil pump 50, the pulsation of the oil pump 50 can be damped in the oil passage from the oil pump 50 through the main gallery 61, the sub gallery 62 and the branch oil passage 64 to the hydraulic pressure sensor 70. Thus, the hydraulic pressure sensor 70 can be prevented from being influenced by the pulsation of the oil pump 50 so that it can detect the hydraulic pressure of oil high-accurately and stably.

The hydraulic pressure sensor 70 is installed in the branch oil passage 64 diverged from the sub gallery 62 further downstream of the main gallery 61 and is disposed remotely from the oil pump 50. It is possible therefore to prevent the hydraulic pressure sensor 70 from being influenced by the hydraulic pressure variations resulting from the pulsation of the oil pump 50. The supply oil passage 61A communicating with the central crank journal 2J is formed as a flow passage with a diameter smaller than that of the main gallery 61, that is, the passage of oil is restricted. Therefore, the pulsation of the oil pump 50 can be damped. Further, the branch oil passage 64 is diverged from the sub gallery 62 so that the diameter of the branch oil passage 64 may become smaller than that of the sub gallery 62, that is, the oil passage is restricted. Therefore, the pulsation of the oil pump 50 can be damped.

Further, the hydraulic pressure sensor 70 is installed upstream of the orifice 66. More specifically, it is disposed at a position where the branch oil passage 64 is not yet reduced in diameter by the orifice 66 so that it is hard for hydraulic pressure to drop. Therefore, the hydraulic pressure can be detected high-accurately and stably by the hydraulic pressure sensor 70.

Furthermore, the hydraulic pressure sensor 70 is installed in the V-bank space K so as to be surrounded by the front bank Bf and the rear bank Br for protection. Therefore, the hydraulic pressure sensor 70 can be protected from disturbance without the provision of a special protecting member, etc.

In addition, the embodiment represents a mode embodying the present invention and the invention is not limited to the embodiment.

The description of the embodiment is such that the hydraulic pressure sensor 70 is attached to the hydraulic pressure sensor attachment portion 71 of the water jacket thick-walled portion 8A in the rear cylinder block 3*r*. However, the present invention is not limited to this. For example, the hydraulic pressure sensor 70 may be installed on a wall surface external of and peripheral of the water jacket 9 in each of the cylinder heads 4*f*, 4*r* and the sensor portion 70A is disposed to face the head-side oil passage 67. Thus, the hydraulic pressure sensor 70 is prevented from being influenced by the heat of the internal combustion engine 1.

The present invention can be applied to three-, four- or more wheeled vehicles as well as to two-wheeled vehicles. It is obvious that other detailed configurations can be modified arbitrarily.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A hydraulic pressure warning system for an internal combustion engine, includes a hydraulic pressure sensor for detecting hydraulic pressure in a lubricating oil passage of the engine and issues a warning based on hydraulic pressure detected by the hydraulic pressure sensor when the hydraulic pressure drops, wherein the hydraulic pressure sensor is provided on a wall surface of a water jacket of a cylinder so as to project therefrom, wherein the internal combustion engine includes a main gallery adapted to distribute lubricating oil discharged from an oil pump to journal bearings for a crankshaft, and a sub gallery branched from the main gallery and adapted to distribute lubricating oil to a cylinder head, and the hydraulic pressure sensor is disposed on an upstream side of an orifice in front of an oil feed portion of the cylinder head downstream of the sub gallery.

2. The hydraulic pressure warning system for the internal combustion engine according to claim 1, wherein the internal combustion engine is a V-type internal combustion engine having cylinders disposed in a V-shape, and the hydraulic pressure sensor is disposed in a V-bank.

3. The hydraulic pressure warning system for the internal combustion engine according to claim 1, wherein the hydraulic pressure sensor is disposed at approximately a branch oil passage in a width direction of the internal combustion engine.

4. The hydraulic pressure warning system for the internal combustion engine according to claim 1, wherein the hydraulic pressure sensor is attached to a hydraulic pressure sensor attachment portion formed on a wall surface on a side of the water jacket thick-walled portion.

5. The hydraulic pressure warning system for the internal combustion engine according to claim 4, wherein the hydraulic pressure sensor is disposed at the water jacket thick-wall portion where temperature is kept low in a rear cylinder block of the internal combustion engine.

6. A hydraulic pressure warning system for the internal combustion engine includes a hydraulic pressure sensor for detecting hydraulic pressure in a lubricating oil passage of the engine and issues a warning based on hydraulic pressure detected by the hydraulic pressure sensor when the hydraulic pressure drops, wherein the hydraulic pressure sensor is provided on a wall surface of a water jacket of a cylinder so as to project therefrom, wherein the hydraulic pressure sensor is attached to a hydraulic pressure sensor attachment portion formed on a wall surface on a side of the water jacket thick-walled portion, wherein the hydraulic pressure sensor is disposed at the water jacket thick-wall portion where temperature is kept low in a rear cylinder block of the internal combustion engine, wherein it is possible to reduce heat of the internal combustion engine from being transmitted to the hydraulic pressure sensor to prevent the hydraulic pressure sensor from being influenced by the heat of the internal combustion engine.

7. The hydraulic pressure warning system for the internal combustion engine according to claim 6, wherein the hydraulic pressure sensor can be an electric type hydraulic pressure sensor wherein an ECU can continuously obtain the hydraulic pressure of oil flowing in a branch oil passage in a wide range from low hydraulic pressure to high hydraulic pressure.

8. The hydraulic pressure warning system for the internal combustion engine according to claim 7, wherein the predetermined hydraulic pressure lower limit of the ECU can be varied according to the rotating speed of the internal combustion engine wherein a warning about the lowering of hydraulic pressure can be issued based on the variable hydraulic pressure lower limit.

9. A hydraulic pressure warning system for an internal combustion engine comprising:

a hydraulic pressure sensor for detecting hydraulic pressure in a lubricating oil passage of the engine and issues a warning based on hydraulic pressure detected by the hydraulic pressure sensor when the hydraulic pressure drops; and a wall surface formed in a water jacket of a cylinder;

wherein the hydraulic pressure sensor projects from the wall surface of the water jacket of the cylinder, wherein the internal combustion engine includes a main gallery adapted to distribute lubricating oil discharged from an oil pump to journal bearings for a crankshaft, and a sub gallery branched from the main gallery and adapted to distribute lubricating oil to a cylinder head, and the hydraulic pressure sensor is disposed on an upstream side of an orifice in front of an oil feed portion of the cylinder head downstream of the sub gallery.

10. The hydraulic pressure warning system for the internal combustion engine according to claim 9, wherein the internal combustion engine is a V-type internal combustion engine having cylinders disposed in a V-shape, and the hydraulic pressure sensor is disposed in a V-bank.

11. The hydraulic pressure warning system for the internal combustion engine according to claim 9, wherein the hydraulic pressure sensor is disposed at approximately a branch oil passage in a width direction of the internal combustion engine.

12. The hydraulic pressure warning system for the internal combustion engine according to claim 9, wherein the hydraulic pressure sensor is attached to a hydraulic pressure sensor attachment portion formed on a wall surface on a side of the water jacket thick-walled portion.

13. The hydraulic pressure warning system for the internal combustion engine according to claim 12, wherein the hydraulic pressure sensor is disposed at the water jacket thick-wall portion where temperature is kept low in a rear cylinder block of the internal combustion engine.

14. A hydraulic pressure warning system for the internal combustion engine, comprising:

a hydraulic pressure sensor for detecting hydraulic pressure in a lubricating oil passage of the engine and issues a warning based on hydraulic pressure detected by the hydraulic pressure sensor when the hydraulic pressure drops; and a wall surface formed in a water jacket of a cylinder;

wherein the hydraulic pressure sensor projects from the wall surface of the water jacket of the cylinder, wherein the hydraulic pressure sensor is attached to a hydraulic pressure sensor attachment portion formed on a wall surface on a side of the water jacket thick-walled portion, wherein the hydraulic pressure sensor is disposed at the water jacket thick-wall portion where temperature is kept low in a rear cylinder block of the internal combustion engine, wherein it is possible to reduce heat of the internal combustion engine from being transmitted to the hydraulic pressure sensor to prevent the hydraulic pressure sensor from being influenced by the heat of the internal combustion engine.

15. The hydraulic pressure warning system for the internal combustion engine according to claim 14, wherein the hydraulic pressure sensor can be an electric type hydraulic pressure sensor wherein an ECU can continuously obtain the hydraulic pressure of oil flowing in a branch oil passage in a wide range from low hydraulic pressure to high hydraulic pressure.

16. The hydraulic pressure warning system for the internal combustion engine according to claim 15, wherein the predetermined hydraulic pressure lower limit of the ECU can be varied according to the rotating speed of the internal combustion engine wherein a warning about the lowering of hydraulic pressure can be issued based on the variable hydraulic pressure lower limit.

17. A hydraulic pressure warning system for an internal combustion engine, includes a hydraulic pressure sensor for detecting hydraulic pressure in a lubricating oil passage of the engine and issues a warning based on hydraulic pressure detected by the hydraulic pressure sensor when the hydraulic pressure drops, wherein the hydraulic pressure sensor is provided on a wall surface of a water jacket of a cylinder so as to project therefrom, wherein the hydraulic pressure sensor is disposed at approximately a branch oil passage in a width direction of the internal combustion engine, wherein the hydraulic pressure sensor includes a sensor portion which overlaps the water jacket when viewed from a lateral side of the internal combustion engine.

18. A hydraulic pressure warning system for an internal combustion engine comprising:

a hydraulic pressure sensor for detecting hydraulic pressure in a lubricating oil passage of the engine and issues a warning based on hydraulic pressure detected by the hydraulic pressure sensor when the hydraulic pressure drops; and a wall surface formed in a water jacket of a cylinder;

wherein the hydraulic pressure sensor projects from the wall surface of the water jacket of the cylinder, wherein the hydraulic pressure sensor is disposed at approximately a branch oil passage in a width direction of the internal combustion engine, wherein the hydraulic pressure sensor includes a sensor portion which overlaps the water jacket when viewed from a lateral side of the internal combustion engine.

* * * * *